US005563558A

United States Patent [19]

Mohwinkel et al.

[11] Patent Number: 5,563,558

[45] Date of Patent: Oct. 8, 1996

[54] REENTRANT POWER COUPLER

[75] Inventors: Clifford A. Mohwinkel; Raymond R. Blasing, both of San Jose, Calif.

[73] Assignee: Endgate Corporation, Sunnyvale, Calif.

[21] Appl. No.: 505,789

[22] Filed: Jul. 21, 1995

[51] Int. Cl.[6] ..... H01P 5/12

[52] U.S. Cl. ..... 333/127; 333/128

[58] Field of Search ..... 333/109, 115–117, 333/120, 127, 128

[56] References Cited

U.S. PATENT DOCUMENTS

| | | | |
|---|---|---|---|
| 2,446,982 | 8/1948 | Pound | 333/127 |
| 3,091,743 | 5/1963 | Wilkinson | 333/127 |
| 4,127,839 | 12/1978 | Galani et al. | 333/128 |
| 4,223,283 | 9/1980 | Chan | 333/109 |
| 4,251,784 | 2/1981 | Luetzelschwab et al. | 333/128 X |
| 4,254,386 | 3/1981 | Nemit et al. | 333/128 |
| 4,485,362 | 11/1984 | Campi et al. | 333/128 |
| 4,492,939 | 1/1985 | Burns | 333/116 |
| 4,613,834 | 9/1986 | Heine | 333/120 |
| 4,636,755 | 1/1987 | Gibbs | 333/116 |
| 4,721,929 | 1/1988 | Schnetzer | 333/127 |
| 4,835,496 | 5/1989 | Schellenberg et al. | 333/128 |
| 4,904,966 | 2/1990 | Rubin | 333/120 |
| 4,937,541 | 6/1990 | Podell et al. | 333/116 |
| 4,968,958 | 11/1990 | Hoare | 333/128 |
| 5,025,233 | 6/1991 | Leonakis | 333/128 |
| 5,150,084 | 9/1992 | Asa et al. | 333/128 |
| 5,206,611 | 4/1993 | Russell | 333/127 |

OTHER PUBLICATIONS

Beckwith, "Wide Bandwith Monolithic Power Dividers", *Microwave Journal*, Feb. 1989, pp. 155–157;160.

Carr, "A High Power Directional Coupler" Rf Design Awards, Sep. 1989, pp. 35–37.

Parad, "Split–Tee Power Divider", IEEE Transactions on Microwave Theory & Techniques, Jan. pp. 91–95.

Saleh, "Planar Electrically Symmetric N–Way Hybrid Power Dividers/ Combiners", IEEE; Jun. 1980, pp. 555–563.

Ashoka, "Shrink Branch–line Hybrids Using Inverters", *RF Design Awards,* Dec. 1992, pp. 56–60.

Wang, "A Simple Approach to a Four–Way Hybrid Ring Power Divider Design", *Microwave and Optical Technology Letters*, Jan. 20, 1991, pp. 61–64.

Staudinger, "Lumped–Element Network's Compose Wide–Bandwith Balun", *Microwaves & RF*, Sep. 1993, pp. 119–121;126.

Agrawal, "An Improved Hybrid–Ring Directional Coupler for Higher Power Split Ratios", Microwave Journal, Nov. 1986, pp. 87–88;90–98.

Kim, "Design of New Hybrid–Ring Directional Coupler Using λ/8 or λ/6 Sections", IEEE . . ., Oct. 1991, pp. 1779–1784.

Ahn, "Miniaturized 3–dB Ring Hybrid Terminated by Arbitrary Impedances", IEEE . . ., Dec. 1994, pp. 2216–2221.

Roy, "Broadband Design of Ring Type Microstrip Power Divider", Microwave & Optical Tech. Letters, Apr. 1990, pp. 119–122.

(List continued on next page.)

*Primary Examiner*—Paul Gensler

*Attorney, Agent, or Firm*—Steven J. Adamson; Edward B. Anderson

[57] ABSTRACT

An asymmetric reentrant power coupler suitable for microwave and millimeter bands that includes k input terminals, a plurality of m output terminals, where m is greater than k, and a network coupling the k input terminals to the m output terminals, the network defining n signal paths, where n is greater that m. An input coupler divides an input signal into at least two signal paths. An output coupler recombines a fraction less than one of the divided input signal for propagation to an output terminal. A portion of the non-recombined input signal is propagated to another output terminal. The reentrant coupler may be implemented using Wilkinson, ring, branched line or other coupler types. Couplers that are generally planar as well as coupler that are non-planar are presented.

13 Claims, 5 Drawing Sheets

OTHER PUBLICATIONS

Mikucki, "A Broad–Band Printed Circuit Hybrid Ring Power Divider", IEEE . . ., Jan. 1989, pp. 112–117.

Li, "CADICAE Design of any Improved Wideband Wilkinson Power Divider", *Microwave Journal*, Nov. 1984, pp. 125–133.

Hamadallah, "Microstrip Power Dividers at mm–Wave Frequencies", Microwave Journal, Jul. 1988, pp. 115–127.

Katsube, "A Novel Aperturce Coupled Microstrip Magic–T", IEEE . . ., Jun. 1992, pp. 245–246.

Chang, "Applications of a High Power Four–Way Power Divider & Combiner & a cross–Over Circuit", *Microwave Journal*, Nov. 1991, pp. 71–85.

Wahl, "Wideband, Unequal Split Ratio Wilkinson Power Divider", *Microwave Journal*, Sep. 1985, pp. 205–209.

Yau, "An N–Way Broadband Planar Power Combiner/Divider", Microwave Journal, Nov. 1986, pp. 147–151.

REENTRANT POWER COUPLER

FIELD OF THE INVENTION

The present invention relates to power couplers, i.e., power dividers/combiners, that are suitable for microwave and millimeter bands and, more specifically, to the division and recombination of power therein.

BACKGROUND AND SUMMARY OF THE INVENTION

Power couplers are known and used widely in the microwave and millimeter wave (hereinafter collectively referred to as "microwave") art to divide power in an input path into two or more output paths. When energy flows in the opposite direction through a power coupler, the coupler acts as a power combiner. Known power couplers include the Lange coupler, branch line coupler, in-line coupler, split-tee coupler and the Wilkinson coupler, amongst others, and the present invention is applicable to all of these and to all other types of couplers. U.S. Pat. No. 4,254,386 for a Three Way Equal-Phase Combiner/Divider Network Adapted for External Isolation Resistors is illustrative of several of these types of couplers.

It is often desirous in power coupling to split an input signal equally between two outputs. In such a division, termed symmetric division, the power at each of the two output ports is half that of the input and the ratio of output power, often termed the split ratio, R, is 1:1 or 1 where the other of the output ports has been standardized to 1. In some instances, it may be desirous to split an input signal unequally such that the R value at two output ports is greater than 1, termed asymmetric division. In the context of microstrip transmission lines (a transmission media amongst others in which the present invention may be practiced), a split ratio of up to 3 (a 3:1 ratio) can be achieved with a conventional asymmetrical Wilkinson coupler, but values greater than 3 are difficult to obtain due to a practical characteristic impedance limit of approximately 100 Ω. For R values greater than 10, electromagnetically coupled lines have been demonstrated as working well. A need exists, however, for couplers having split ratios between 3 and 10. A need also exists for couplers with split ratios above 10 that have advantages over the prior art with respect to material, manufacturing, durability, size, performance, etc.

The present invention overcomes the shortcomings of the prior art with a reentrant power coupler that accommodates a range of split ratios of approximately $2<R<10$, where the upper limit may extend above 10. The use of a reentrant design in a power coupler having direct electrical connections is not presently known.

In an embodiment of the present invention, the reentrant power coupler includes k input terminals, a plurality of m output terminals, where m is greater than k, and a network of n signal paths between the k input terminals and the m output terminals, where n is greater than m, due to a recombination of signal paths.

The reentrant power coupler of the present invention may comprise a signal propagating input terminal having at least a first and a second signal propagation section connected thereto; a first signal propagating output terminal having at least a third and a fourth signal propagation section connected thereto; a first signal path from the input terminal to the first output terminal that includes the first section coupled to the third section such that at least a portion of a signal input to the first section is propagated to the third section; and a second signal path from the input terminal to the first output terminal that includes the second section coupled to the fourth section such that at least a portion of a signal input to the second section is propagated to the fourth section; wherein the second signal path includes a bifurcation that propagates a portion of a signal passing therethrough to the fourth section and a separate portion of the signal passing therethrough to a second signal propagation output terminal.

In another embodiment of the present invention, the reentrant power coupler may comprise an input signal propagating segment approximately an odd multiple of one quarter of a design wavelength in length and having a first characteristic impedance; an output signal propagating segment approximately an odd multiple of one quarter of a design wavelength in length and having a second characteristic impedance that is approximately equal to the first characteristic impedance, the output segment having a common physical boundary along one side with the input segment; and a tap segment formed integrally with the input and output segments at the physical boundary, the tap segment having an approximate length of an odd multiple of one quarter of a design wavelength and a third characteristic impedance that is higher than the first or second characteristic impedances.

The coupler of the present invention may be practiced in both a generally planar or non-planar form and tap segments extending thereform need not be located at a common boundary between an input segment and an output segment thereof.

The present invention may also be achieved in several different embodiments and among the different coupler types, such as those cited above and those described below and combinations thereof.

The input may be any of various size Wilkinson-type couplers or some other bifurcating transmission line/waveguide configuration, such as hybrid ring coupler or the like. The characteristic impedance of the reentrant coupler is selected to provide a desired split ratio. Couplers are disclosed with multiple power taps. Multiple reentrant coupler combinations are also disclosed.

In yet another embodiment of the present invention, a reentrant coupler is formed of a plurality of cascaded transformer segments to enhance bandwidth.

The attainment of the foregoing and related advantages and features of the invention should be more readily apparent to those skilled in the art, after review of the following more detailed description of the invention taken together with the drawings.

DETAILED DESCRIPTION

Figure 1:
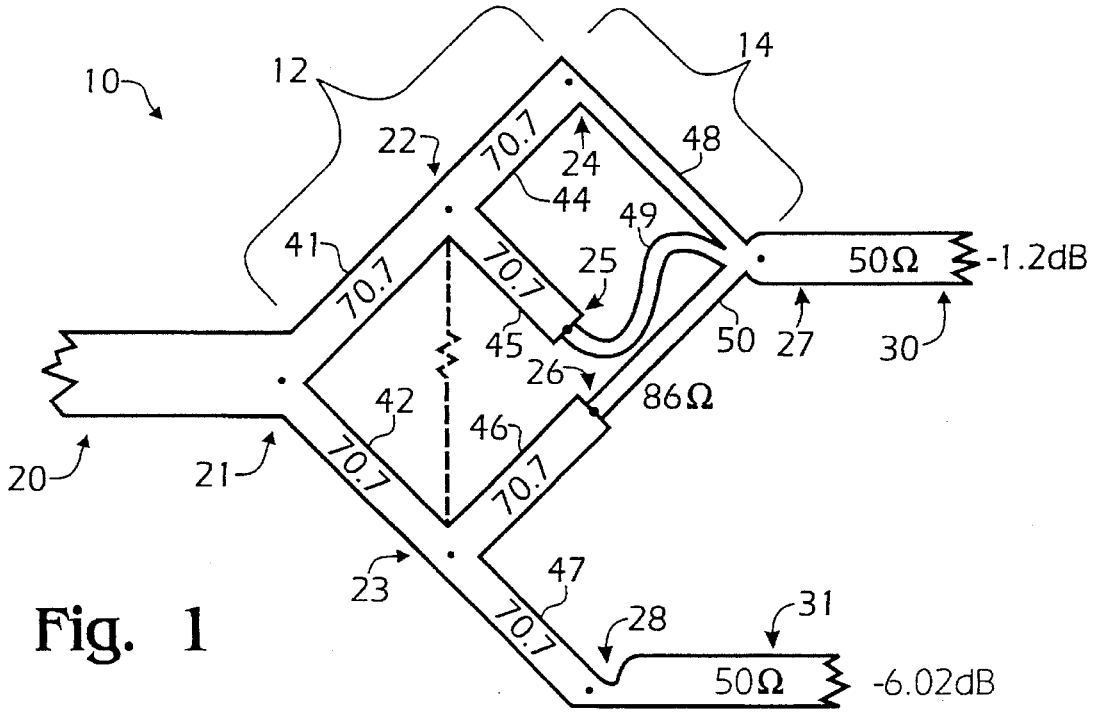
FIG. 1 is a schematic plan view of a reentrant asymmetric multiple Wilkinson-type power coupler made according to the invention.

Referring to FIG. 1, an embodiment of a reentrant power coupler is shown. The term "reentrant" as used herein generally refers to the division of an input power signal and the recombination or "reentering" of portions, less than whole, of the divided power signal at an output.

In the embodiment of FIG. 1, the inventive concept of reentrant power coupling is implemented using multiple Wilkinson couplers or the like to thus form a reentrant Wilkinson coupler 10 according to the invention. It should be recognized that while a standard Wilkinson coupler has an isolation resistor(s), the Wilkinson couplers of the present invention may or may not have isolation resistors depending on their desired area of use as known in the art. The present invention may be practiced in microstrip transmission media, in which a strip of conducting material such as metal is provided over a ground plane and separated therefrom with dielectric material, or in other transmission media such as stripline, CPW, CPS, waveguide, etc.

The coupler 10 comprises a four way Wilkinson coupler 12 and a three way Wilkinson coupler 14. These two couplers are joined such that one input terminal 20 and two output terminals 30,31 are formed. It should be appreciated that the terms input and output, in the context of couplers, are interchangeable designations that depend on the direction of signal flow within a coupler. The input of a power divider is the output of a power combiner and vice versa. Thus, to avoid redundancy, the term input as used herein is intended to include outputs and conversely the term output is intended to include inputs.

The four way coupler 12, which divides an input signal among four signal paths, includes a first two way split at point 21 and two second two way splits at points 22 and 23. These bifurcations define signal propagation segments 41–42 and 44–47 and establish connection points at 24, 25, 26 and 28. For the coupler 10, the signal propagation segments are preferably transmission lines, but in other coupling devices they may include waveguides, etc. Each of segments 41–42 and 44–47 is configured to have a length equal to ¼ of a design wavelength, e.g., the effective wavelength of the propagating signal in the material the segment is made of, and a characteristic impedance of 70.7 Ω. The value 70.7 Ω is derived as follows. When the coupler is connected to a 50 Ω transmission line at ports 20,30,31, each of the segments 41–47 transforms from 50 Ω to 100 Ω (50 Ω in two parallel paths), and thus, the impedance value is $(50*100)^{1/2}=70.7$.

The three way coupler 14 comprises three signal propagation segments 48–50 that are preferably transmission lines and which connect between point 27 (port 30) and points 24–26, respectively. Each of the transmission lines 48–50 is ¼ wavelength in length and has a characteristic impedance of 86 Ω. The 86 Ω value is derived from the impedance transformation of 150 Ω (50 Ω in three parallel paths) to 50 Ω at output 30, which is $(150*50)^{1/2}=86.6$.

Point 28 is coupled directly to output port 31 which, in the embodiment of FIG. 1, has a characteristic impedance of 50 Ω.

Four signal paths from input 21 to outputs 30,31 are created in the coupler 10. The first is through segments 41,44,48; the second is through segments 41,45,49; the third is through segments 42,46,50; and the fourth is through segments 42,47.

The coupler 10 divides the power of an input signal at point 21 to ¾ of its magnitude (10*log(¾)=−1.2 dB) at point 27 and ¼ of its magnitude (10*log(¼)=−6.02 dB) at point 28. Accordingly, the coupler 10 has a split ratio of 3.

If desired, resistances can be provided to ensure isolation and back match. For example, a resistance, $R_t$, where the "t" is for termination, of 100 Ω between points 22 and 23 will form a standard Wilkinson coupler.

It should be recognized that in a modified embodiment of the coupler of FIG. 1, the segments between points 22, 24 and 27 and the segments between points 22, 25 and 27 can each be combined into single lengths that transform 150 Ω (50 Ω in parallel) at point 27 to 100 Ω at point 22. Similarly, the segments between points 23, 26 and 27 can be combined into a single length that transforms 150 Ω at 27 to 100 Ω at point 23. The characteristic impedance of each of these resultant single lengths is $(150\times100)^{1/2}=122.47$ Ω. Since 100 Ω is in some instances a practical limit of characteristic impedance for microstrip devices, this modified embodiment of coupler 10 may be unrealizable on some types of substrates.

Figure 2:
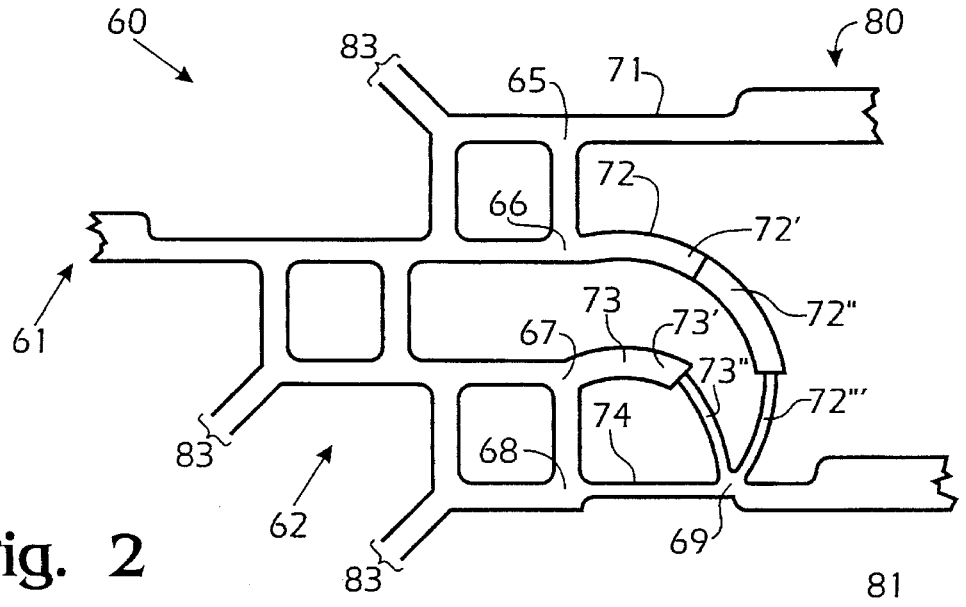
FIG. 2 is a schematic plan view of a reentrant asymmetric power coupler having multiple quadrature couplers made according to the invention.

Referring to FIG. 2, another embodiment of a reentrant power coupler according to the invention is shown. In this reentrant power coupler 60, the input terminal 61 is connected to three quadrature branch line couplers, labelled collectively as 62. Such couplers are known in the art and split a radio frequency signal among four ports, which in the embodiment of FIG. 2 are provided in the form of four transmission lines 71–74. In a preferred embodiment, the transmission paths in the reentrant coupler 60 have characteristic impedance values of 50 Ω, except as otherwise noted herein.

The coupler 60, as shown, is configured to split the magnitude of an input signal approximately equally among the four transmission lines 71–74, though depending on a specific design requirement, the coupler 60 may be configured otherwise. The coupler 60 induces a phase shift in the four divided components of the input signal such that if a signal at point 65 is considered to be in phase, the signals at points 66–68 are respectively −90, 0 and +90 degrees out of phase with respect to the signal at point 65. The quadrature branch line couplers 62 also contain three terminations 83 which are of a type known in the art.

Transmission line 72 includes three quarter wavelength transmission segments, two that have a characteristic impedance of 50 Ω (72',72") and one with a characteristic impedance of 86 Ω (72'''). Transmission line 73 includes two quarter wavelength transmission segments, one that has a characteristic impedance of 50 Ω (73') and one with a characteristic impedance of 86 Ω (73"). Transmission line 74 includes one quarter wavelength transmission segment that has a characteristic impedance of 86 Ω. The 86 Ω segments of transmission line 72–74 are provided to transform from 50 Ω (the characteristic impedance of point 69 and output terminal 81) to 150 Ω (50 Ω in three parallel paths 72''',73",74) and accordingly their impedance values are $(50*150)^{1/2}$=86 Ω.

The coupler 60 effectively combines ¾ of the energy of an input signal at point 69, for propagation to output terminal 81. The remaining ¼ of the energy of an input signal is propagated through transmission line 71 to output terminal 80. The split ratio, R, of coupler 60 is 3 (3:1) and the output power at terminals 80 and 81 is 10*log(¼)=–6.02 dB and 10*log(¾)=–1.2 dB, respectively.

Figure 3:
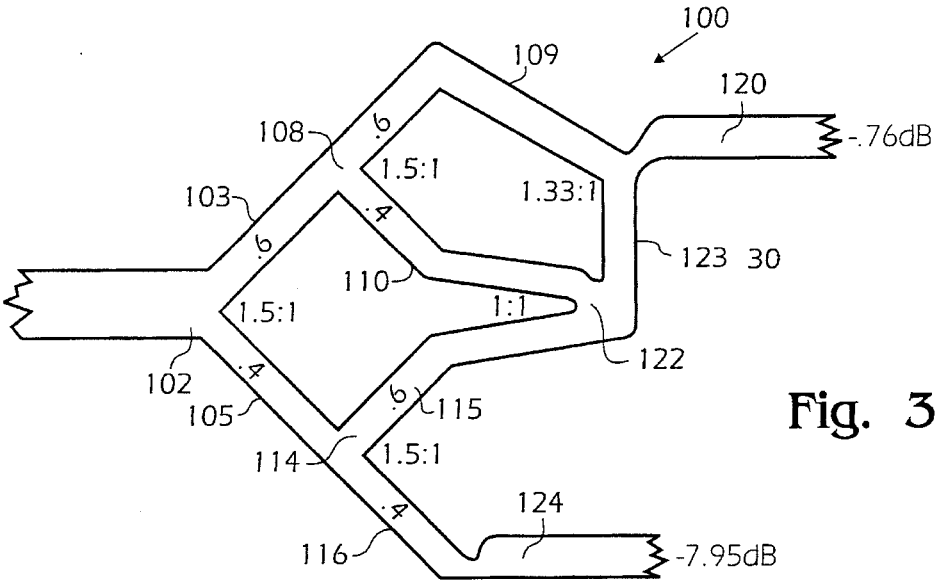
FIG. 3 is a schematic plan view of a reentrant asymmetric Wilkinson-type power coupler made according to the invention.

Referring to FIG. 3, a further embodiment of a reentrant asymmetric power coupler according to the invention is shown. The coupler 100 of FIG. 3 illustrates, amongst other factors, the diversity of possible configurations for a reentrant Wilkinson type coupler.

In this coupler 100, in which all of the segments have a length of one quarter of a design wavelength, a 1.5:1 power split is induced at input (output) port 102 by forming signal propagating segments 103 and 105 with impedances that achieve the 1.5:1 ratio. As a result, 0.6 of the power at input 102 is propagated to point 108 and 0.4 of the input power is propagated to point 114. At points 108 and 114, a similar 1.5:1 split is induced. Thus, segment 109 propagates 0.6×0.6=0.36 of the input power, segment 110 propagates 0.6×0.4=0.24 of the input power, segment 115 propagates 0.4×0.6=0.24 of the input power and segment 116 propagates 0.4×0.4=0.16 of the input power. Methods of forming signal propagation segments to produce these propagation proportions are known in the art.

At point 122, the signals in segments 110 and 115 are combined into segment 123. Signals in segments 109 and 123 are then combined at a first output port 120. The power at this output port is 0.36 (from segment 109) +0.48 (the combined power of segment 110 and 115) for a total of 0.84 of the input power. This provides an output level of 10*log(0.84)=–0.76 dB. The power at output port 124 is 0.16 of the input signal which provides an output level of 10*log(0.16)=–7.96 dB. Accordingly, the coupler 100 has a split ratio of 0.84 to 0.16 or 5.25:1.

Figure 4:
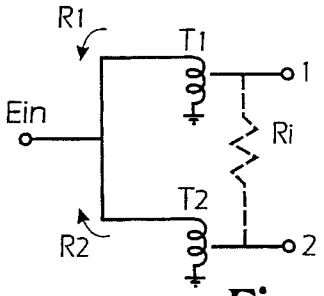
FIG. 4 is a schematic model of a Wilkinson coupler.

Impedance values for embodiments such as the coupler of FIG. 3 and the like may be determined by one skilled in the art given the teachings herein and the design criteria provided with reference to FIG. 4.

Referring to FIG. 4, a schematic model of a non-reentrant Wilkinson coupler is shown. Though the model is specifically representative of a standard two output Wilkinson coupler, such as the coupler 134 of FIG. 5, it is applicable to bifurcations within a multi-bifurcated coupler, such as coupler 100 of FIG. 3 or 130 of FIG. 5.

For an equal split (–3 dB) at 1 and 2, the impedance presented by transformers 1 and 2 (which are inherent transformations based on the characteristic impedance of the respective transmission lines) is 2×50=100 Ω so that when they are combined in parallel, the input impedance is 50. Thus, $R_1$=$R_2$=100 Ω.

For lossless asymmetric couplers, the following law must be obeyed:

$$P_{in} = P_{out1} + P_{out2}$$

or $$\frac{E_{in}^2}{R_{in}} = \frac{E_{in}^2}{R_1} + \frac{E_{in}^2}{R_2}$$

where $R_{in}$ is the impedance presented to the input, $R_1$ is the impedance of port 1 that is seen from the input as transformed by $T_1$ and $R_2$ is the impedance of port 2 that is seen from the input as transformed by $T_2$. The split ratio is $R=R_1/R_2$.

For lossless coupling the fractional power split is related as $P_1+P_2=1$, and since $R=P_2/P_1$ (or $P_1/P_2$ depending on which output port is standardized to 1), $P_1=1/(R+1)$ and $P_2=(1-P_1)$.

Applying these equations to coupler design, if a split ratio of 3 is desired in a standard Wilkinson coupler or a similar bifurcation, then $R=R_1/R_2=3$ and $$\frac{1}{50} = \frac{1}{3R_2} + \frac{1}{R_2}$$

or $R_2$=66.67 Ω and $R_1$=3*$R_1$=200 Ω. This means that transformer $T_1$ transformed 50 Ω up to 200 Ω and transformer $T_2$ transformed 50 Ω up to 66.67 Ω. Thus, the quarter wave segment that inherently contains $T_1$ is configured to have an impedance of $(50*200)^{1/2}$=100 Ω and the quarter wave segment that inherently contains $T_2$ is configured to have an impedance of $(50*66.67)^{1/2}$=57.7 Ω. Given these design guidelines, selection of appropriate impedance would be apparent to one skilled in the art.

Though the coupler 100 is varied in comparison to those of FIGS. 1 and 2, there are yet many other variations that would be apparent to one skilled in the art given the teachings herein, particularly in view of the embodiments which follow.

Figure 5:
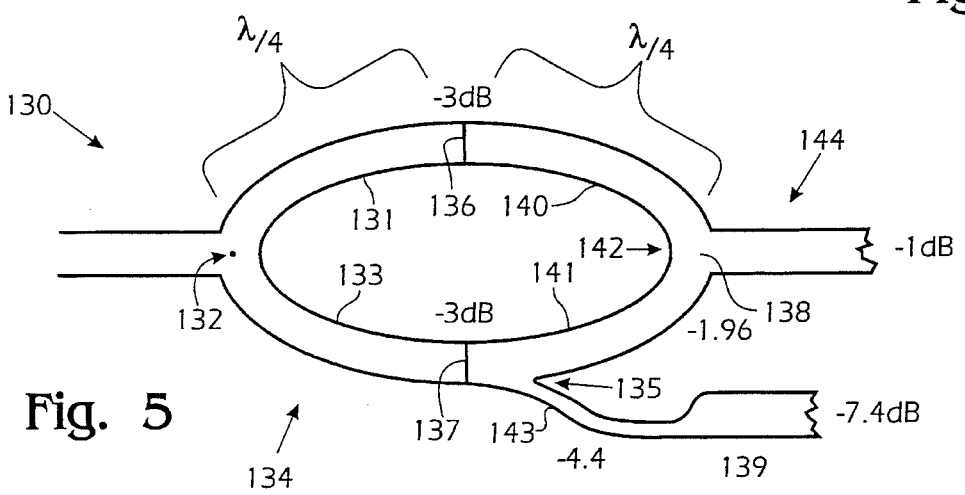
FIG. 5 is a schematic plan view of a reentrant asymmetric power coupler having one symmetric and two asymmetric couplers made according to the invention.

Referring to FIG. 5, a reentrant coupler 130 having one symmetric coupler and two asymmetric couplers according to the invention is shown. The coupler 130 has an open center or "eye" region and represents a relatively basal form of an asymmetric reentrant Wilkinson coupler.

In the reentrant coupler 130, a signal at input (output) port 132 is split by an input coupler 134 into two quarter wave signal propagation segments 131 and 133, which are preferably transmission lines as are the other signal propagation segments in coupler 130. In this arrangement, the input coupler 134 functions essentially as a hub and the signal propagating segments as spokes. Though coupler 134 as shown is symmetrical, hence the split into two –3 dB power transmission levels, it should be recognized that this coupler may be asymmetrical. The coupler 134 is coupled to an output coupler 142 which in turn is coupled to an output port 144.

The output coupler 142 has two signal propagation segments 140 and 141 which are combined asymmetrically, in the present embodiment. An additional signal propagation segment 143 is connected to segments 133 and 141 in such a manner that another hub is formed with segments 141 and 143 as the spokes. The impedance of segments 141 and 143 are selected such that a known portion of the input power is propagated through each segment and only a small portion is propagated through segment 143 to thereby increase the overall split ratio of the coupler 130.

In a specific embodiment, the coupler 130 may be configured to have a split ratio of 4.5 (or 4.5 to 1). Assuming that input coupler 134 is symmetrical, 0.5 of the input power is propagated to points 136 and 137. If the split at bifurcation 135 is such that −1.96 dB and −4.4 dB of the signal at point *137 are respectively propagated to segments 141 and 143,* then the power at point 138 is 0.5+0.318) or 10*log(0.818)= −0.87 dB of the input signal and that at point 139 is (1−0.818) or 10*log(0.182)=−7.4 dB of the input signal. The split ratio is 0.818:0.182 or 4.5:1.

Characteristic impedance values for this R=4.5 coupler depend on the impedance of the transmission lines coupled at the input and outputs, but would be apparent to one skilled in the art in keeping with the general guidelines herein. It should be recognized that couplers 100 and 130, amongst others herein, can be modified following the present teachings to produce couplers having higher split ratios. The upper limit of the split ratio for a coupler depends on the type of substrate, configuration, size, etc., and is generally controlled or limited by such factors as substrate dielectric constant, dielectric thickness, maximum transmission line impedance and available area for cascading (when cascading is implemented).

Figure 6:
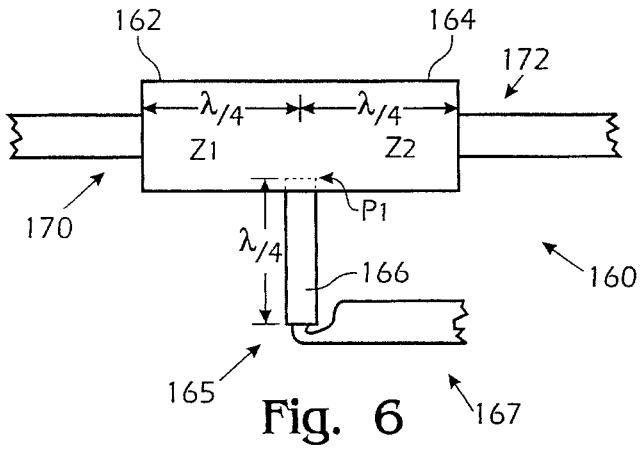
FIG. 6 is a schematic plan view of an asymmetric power coupler having a high impedance tap made according to the invention.

Referring to FIG. 6, an "eyeless" reentrant coupler 160 having a high impedance tap according to the invention is shown. This coupler is similar to coupler 130 of FIG. 5, though the "eye" or open center region of coupler 130 is filled with a conducting substance such as metal. The coupler 160 is comprised of input 162 and output 164 signal propagation segments, which are transmission lines in a preferred embodiment. The input and output segments are formed such that they share a common physical boundary along one side and as shown here have a length of one quarter of a design wavelength, though their length may be any odd multiple of a quarter of a design wavelength. A tap 165 is achieved by the formation of a conductor 166 which may extend into the body of segments 162 and 164 at their common boundary to a point, $P_1$, depending on the thickness of segments 162 and 164. The length of the tap 165 as shown is a quarter of a design wavelength, though it also may have a length of any odd multiple of one quarter of a design wavelength. It should be recognized, however, that although lengths which are integer odd multiples of a quarter of a design wavelength are preferred, the use of other than integer odd multiples may be advantageous in some scenarios and such use in contemplated in the present invention. In operation, a portion of the current propagating in input segment 162 (which propagates primarily along the surface as is known) contacts and propagates into the tap 165 while the remainder is propagated into the output segment 164. Thus, the coupler 160 of FIG. 6 divides a signal input thereto between an output segment and a tap, in a manner similar to that of the couplers of FIGS. 1–3 above, though the entire surface of coupler 160 may be conducting current.

A feature of this coupler 160 is that the two quarter wave segments 162,164 are arranged back-to-back, such that if segment 166 is not there, the transmission between the input 170 and output 172 is perfect. The perfection in transmission is achieved because one of the quarter wave segments transforms down in impedance and the other transforms back up. The location of point $P_1$ is at a low impedance position at the common boundary between segments 162 and 164. The tap segment 166, however, has a relatively high characteristic impedance and thus, will not load appreciably the transmission line from input 170 to output 172. This configuration forms a low power tap at the tap output 167.

The split ratio, R, for the "eyeless" high impedance tap coupler 160 of FIG. 6, is derived as follows. If the through impedance, that seen looking into the coupler 160 is defined as $Z_{io}$ and the characteristic impedance of the first 162, second 164 and third 166 quarter wave segments are defined as $Z_1$, $Z_2$ and $Z_3$, respectively, and $E_1$ is the voltage at $P_1$, then $Z_1=Z_2$, $(Z_1)^2/50=Z_{io}$ and $(Z_3)^2/50=Z_t$ where the through impedance, $Z_{io}$, is 50 Ω and $Z_t$ is the tap impedance that is in parallel with $Z_{io}$.

As such, the power split ratio, R, is:

$$\frac{\frac{E_1^2}{Z_t}}{\frac{E_1^2}{Z_1^2}} = \frac{\frac{(Z_1)^2}{(50)^2}}{\frac{(Z_3)^2}{(50)^2}} = \frac{(Z_1)^2}{(Z_3)^2} = R$$

With a typical $Z_1$ of 50 Ω, various values of $Z_1$ yield the R values provided in Table I when plugged into the above equation, noting that R may be written as R or 1/R, depending on which of the output ports (taps) is standardized to 1.

TABLE I

Split Ratios for High Impedance Tap

| $Z_1$ | $Z_3$ | R |
|---|---|---|
| 50 | 75 | 2.25 |
| 50 | 100 | 4 |
| 50 | 125 | 6.25 |
| 50 | 150 | 9 |

To illustrate the significance of these R values, a similar analysis for a standard (non-reentrant) asymmetric Wilkinson coupler is now presented.

Figure 7:
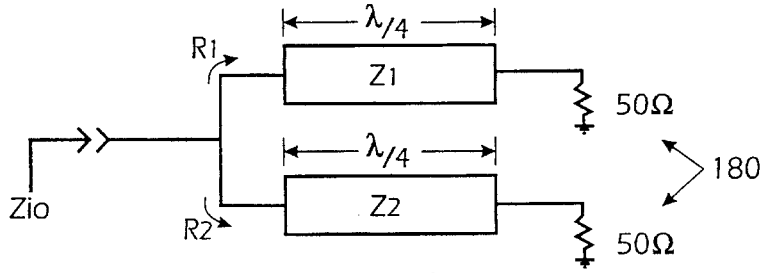
FIG. 7 is a model of a non-reentrant asymmetric Wilkinson type power coupler.

Referring to FIG. 7, a model of a standard, potentially asymmetrical Wilkinson coupler that will be used to illustrate the effects of segment characteristic impedance on split ratio is shown. If $Z_{in}$ of this coupler is equal to 50 Ω, then $Z_1$ and $Z_2$ transform the 50 Ω output lines 180 into $R_1$ and $R_2$, where $50=R_1*R_2/(R_1+R_2)$, $R_1=Z_1^2/50$ and $R_2=Z_2^2/50$. Substituting in the latter values of $R_1$ and $R_2$ into the first of these equations and simplifying gives:

$$2500=Z_1^2*Z_2^2/(Z_1^2+Z_2^2) \quad (1).$$

Since the split ratio for a Wilkinson coupler (which will be designated $R_W$) can be equated to the following:

$$R_W=(Z_1^2/50)/(Z_2^2/50)=R_1/R_2 \text{ and} \quad (2)$$

$$R_W=(E^2/R_2)/(E^2/R_1)=R_1/R_2 \quad (3),$$

equations (2) and (3) can be combined to give $R_W*Z_2^2=Z_1^2$.

Substituting this result into equation (1) above gives:

$$2500=(Z_2^2*R_W*Z_2^2)/(Z_2^2R_W+Z_2^2)$$

or $$2500=R_W*Z_2^2/(R_W+1).$$

Solving for R then provides that $$R_W1/(Z_2/50)^2-1) \quad (4).$$

In a manner analogous to that indicated for the coupler of FIG. 6, values of $Z_2$ can be plugged into equation (4) to determine the theoretical power splitting capability of a non-reentrant asymmetric Wilkinson coupler. The results are provided in Table II.

TABLE II

| Split Ratios of Asymmetric Wilkinson | |
|---|---|
| $Z_2$ | R |
| 75 | 1.25 |
| 100 | 3 |
| 125 | 5.25 |
| 150 | 8 |

Comparing the values in Table I and Table II, it becomes evident that the "eyeless" high impedance tap coupler 160 provides higher split ratios than does a standard asymmetric Wilkinson type coupler.

Continuing in this analysis, for large values of $Z_2$, $R_W=1/(Z_2/50)^2$. Since the split ratio of high impedance tap coupler 160, which will be designated as $R_T$ (for Tap)$=Z_1^2/Z_3^2$, the split ratios of the two couplers can be related as follows:

$$R_T/R_W=(Z_1^2*50^2)/(Z_3^2*Z_2^2) \quad (5).$$

Since $Z_3^2$ for $R_T$ is functionally the same as $Z_2^2$ for $R_W$, equation (5) can be reduced to $$R_T/R_W=Z_1^2/50^2 \quad (6).$$

An implication of equation (6) is that if the signal propagation segment (transmission line) having the characteristic impedance $Z_1$ can be made wide enough to be reduce $Z_1$ down to 25 Ω, then:

$$R_T/R_W=25^2/50^2=1/4$$

or a four times larger split can be obtained with high impedance tap coupler 160 than with an asymmetrical Wilkinson coupler.

In addition to the embodiments of a reentrant coupler shown above which have focused primarily on Wilkinson type couplers, a reentrant configuration (to achieve a desired split ratio) may be implemented using other known couplers.

Figure 8:
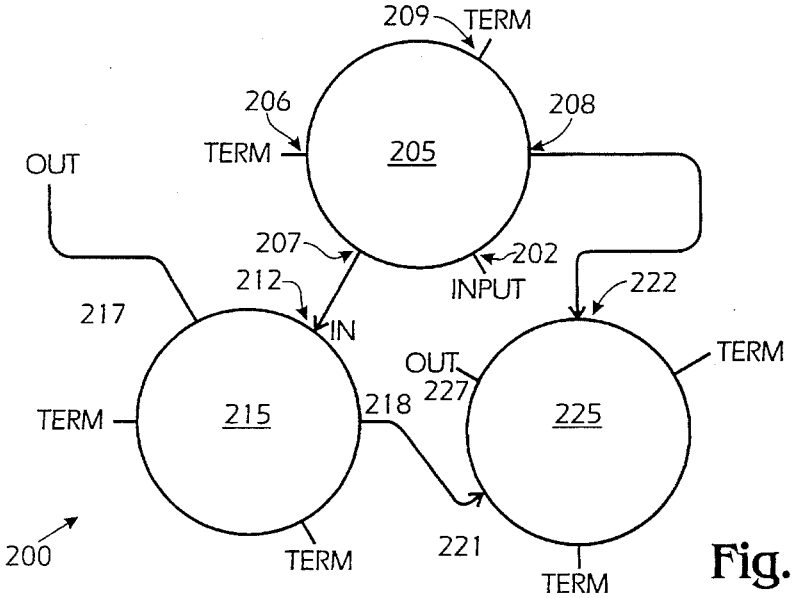
FIG. 8 is a schematic diagram of a multi-ring reentrant asymmetric hybrid-type power coupler made according to the invention.

For example, referring to FIG. 8, an embodiment of a reentrant multiple-ring hybrid coupler 200 according to the invention is shown. This coupler 200 can achieve significantly higher tap ratios (split ratios) than a single ring hybrid and has the advantage that a termination can be attached to the isolation ports resulting in increased bandwidth and flatter amplitude and phase ripple.

In the coupler 200, energy is inputted at input port 202 to the first ring coupler 205 where it is split between a first 207 and a second 208 output port. The relative power level split is determined by the respective line impedance of the paths from input 202 to output ports 207 and 208. A third 206 and fourth 209 port in ring coupler 205 have terminations.

Port 207 is connected to the input port 212 of a second ring coupler 215 while port 208 is connected to the input port 222 of a third ring coupler 225. A signal propagated into coupler 215 is split between output ports 217 and 218. Port 217 forms one of the output ports of multi-ring coupler 200. Port 218 propagates a signal to input port 221 of coupler 225. In coupler 225, the signal input from input ports 221 and 222 are combined and output at output 227 which forms another output port of coupler 200. All impedances are determined using commonly known ring hybrid design equations to result in the desired final tap ratios.

In addition to enhanced split ratios, reentrant couplers may also be directed to increasing operating bandwidth. Increased bandwidth permits use in a wider array of applications and the lack of an increased operating bandwidth has been a limitation of microstrip devices formed on some substrates.

Figure 9:
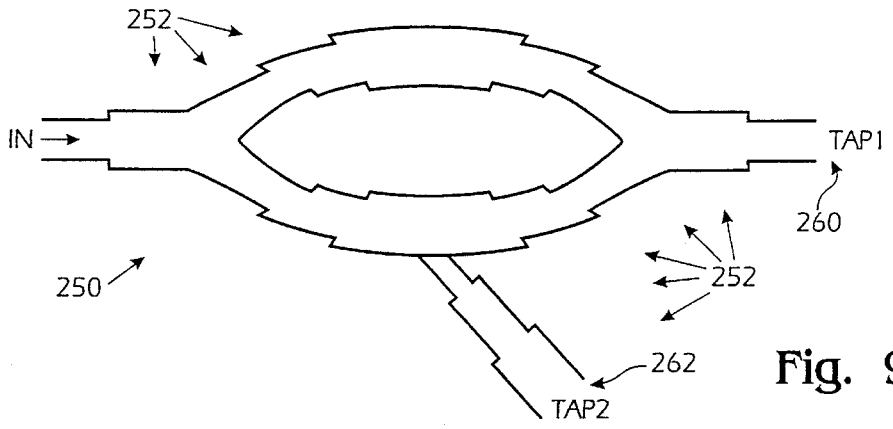
FIG. 9 is a schematic plan view of a reentrant asymmetric power coupler having an enhanced bandwidth of operation made according to the invention.

Referring to FIG. 9, a reentrant power coupler 250 according to the invention, similar to coupler 130 of FIG. 5, yet having multiple sections of cascaded quarter wave transformers is shown. The quarter wave transformer or "multiple step" transforming sections 252 are provided to broadband the overall performance of the coupler 250. As the number of individual sections 252 increases, the bandwidth of the coupler 250 increases. This technique thus facilitates a reduction of the inherent bandwidth narrowing phenomena that occurs as split ratio increases. The impedance values (of the transforming sections 252) that are required to achieve a desired split (tap) ratio are determined using the teachings herein and as otherwise known to one skilled in the art.

It should be recognized that the multiple step technique illustrated in FIG. 9 for a Wilkinson type coupler may similarly be implemented in any number of other couplers or combinations thereof, including ring and branched line hybrids.

Figure 10:
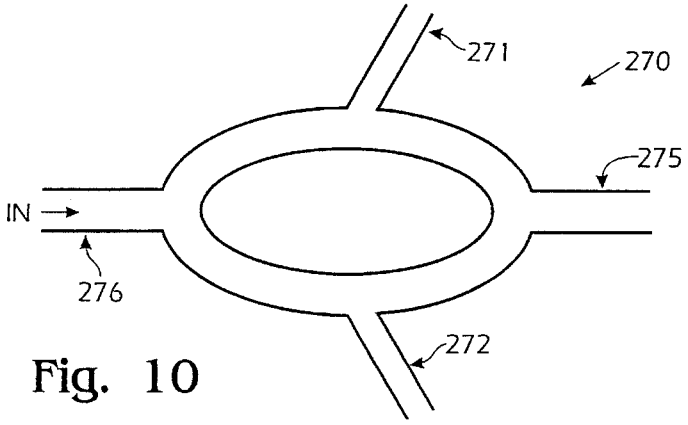
FIG. 10 is a schematic plan view of a reentrant asymmetric power coupler having three outputs made according to the invention.

Referring to FIG. 10, a coupler 270 according to the invention is shown in which energy at input 276 is split amongst two low power taps (outputs) 271 and 272 and a high power tap 275. This embodiment illustrates, amongst other features, that several tap arrangements are possible.

Figure 11:
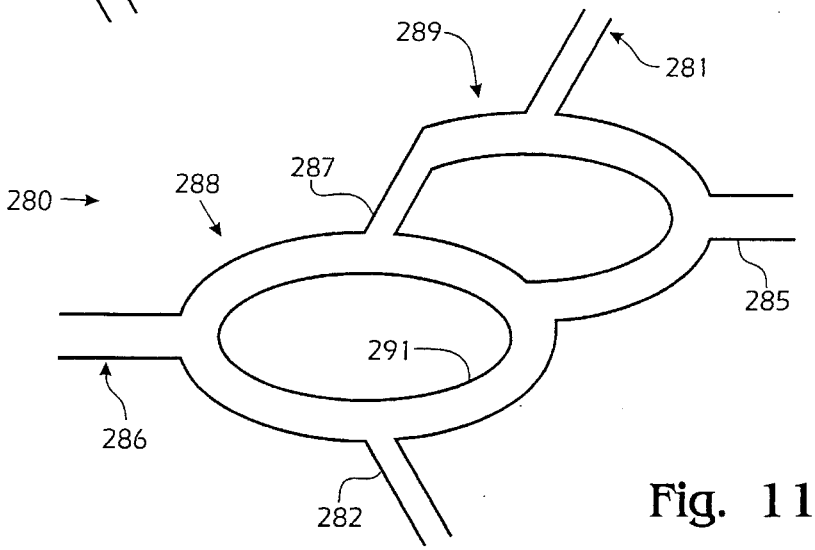
FIG. 11 is a schematic plan view of multi-stage reentrant asymmetric power coupler made according to the invention.

Referring to FIG. 11, a coupler 280 according to the invention is shown that illustrates the combination of a first reentrant coupler 288 and a second reentrant coupler 289. The combined coupler 280 has three outputs 281,282,285 as in coupler 270, but may provide higher split ratios. For example, if output 281 of coupler 289 is a low power output and output 287 of coupler 288 is also a lower power output, then the power propagated through output 281 is more limited than that propagating through a singular low power output (e.g., output 271 above), thereby resulting in a higher split ratio.

Figure 12:
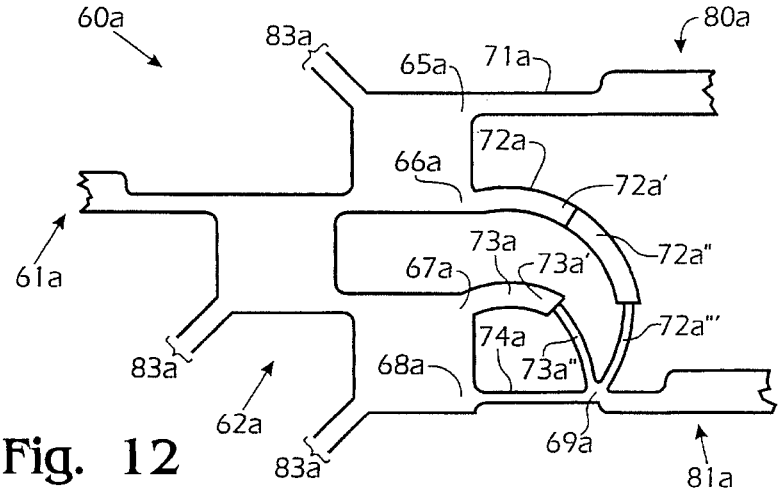
FIG. 12 is a schematic view of a coupler having eyeless and non-eyeless portions made according to the invention.

Referring to FIG. 12, a coupler **60*a* according to the invention that combines features of the coupler 60 and the coupler 160 of FIGS. 2 and 6, respectively, is shown. The coupler 60*a* is provided, amongst other reasons, to illustrate that a volume between conducting members in the couplers illustrated above and the like, such as that between the three quadrature branched line couplers 62 of FIG. 2, may be filled to form solid, "eyeless" conductors. Examples of filled volume or "eyeless" versions of couplers include coupler 160 of FIG. 6 which is an "eyeless" version of coupler 130 of FIG. 5 and the three "eyeless" quadrature branch line couplers, designated collectively as 62*a* in FIG. 12, which are an "eyeless" version of the couplers 62 of FIG. 2. Thus, a reentrant coupler in accordance with the present invention may be completely non-eyeless, e.g., like coupler 10 of FIG. 1; completely eyeless, e.g. like coupler 160 of FIG. 6 or the quadrature branch line couplers 62*a* of FIG. 12; or a combination thereof, e.g., like coupler 60*a* of FIG. 12. Furthermore, couplers having three or more taps, such as couplers 270 and 280** above, could also be be eyeless, partially eyeless or non-eyeless in construction.

Referring more specifically to FIG. 12, the amount of either up or down transformation induced between input **61*a* and points 65*a*–69*a* is preferably complementary to the amount of transformation induced between points 65*a*–69*a* and output 81*a*. In addition, the items labelled with reference numbers 65*a*–69*a*, 71*a*–74*a*, 80*a*–81*a* and 83*a* are analogous to those items labelled 65–69, 71–74, 80–81 and 83 of coupler 60 of FIG. 2**.

Figure 13:
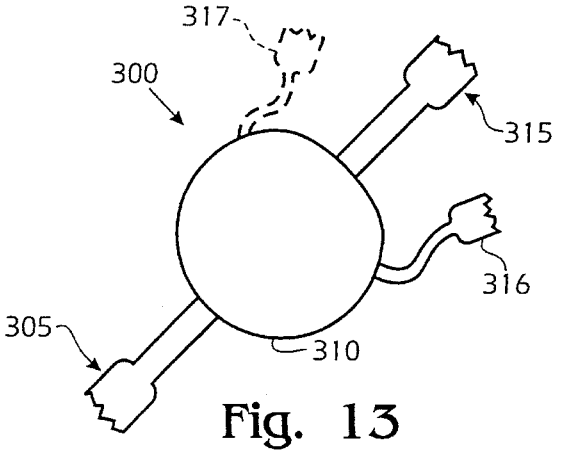
FIG. 13 is a schematic view of a coupler having a generally planar disk shape made according to the invention.

Referring to FIG. 13, a schematic view of a disk-shaped or filled ring coupler 300 according to the invention is shown. The coupler 300 contains an input terminal 305 which is coupled to a generally planar disk 310 made of a good conducting material which may be copper, silver, gold, metal plated plastic or the like. A main output terminal 315 is also coupled to disk 310 as is a first tap 316. Additional taps may also be provided depending on the particular need the coupler is designed to meet and they are indicated generally by tap 317 shown in dashed lines.

The transmission means into coupler 300 and the coupler itself are preferably microstrip or stripline and appropriate dielectric material and ground plane is provided as in known in the art.

The design criteria for coupler 300 are similar to those for eyeless coupler 160 of FIG. 6, the distance from the input to the output terminals being a multiple of half a design wavelength and the tap having a length of approximately an odd multiple of one quarter of a design wavelength.

While the coupler 300 is displayed as a disk, which is preferred, amongst other reasons, because it may facilitate a matching of wavelength distances, it should be recognized that variations of the disk shape are contemplated.

3-Dimensional Coupler

Though the figures above represent the couplers as being primarily 2 dimensional, i.e., planar, it should be recognized that their configuration may be 3-dimensional. For example, coupler 160 of FIG. 6 could be formed to have a football shape or other 3-dimensional shape, and the coupler 280 of FIG. 11 could be formed of a bulbous mass of good conducting material from which outputs 281, 282 and 285 extend. The design criteria for a 3-dimensional coupler are the same as those discussed above for the planar couplers.

Figure 14:
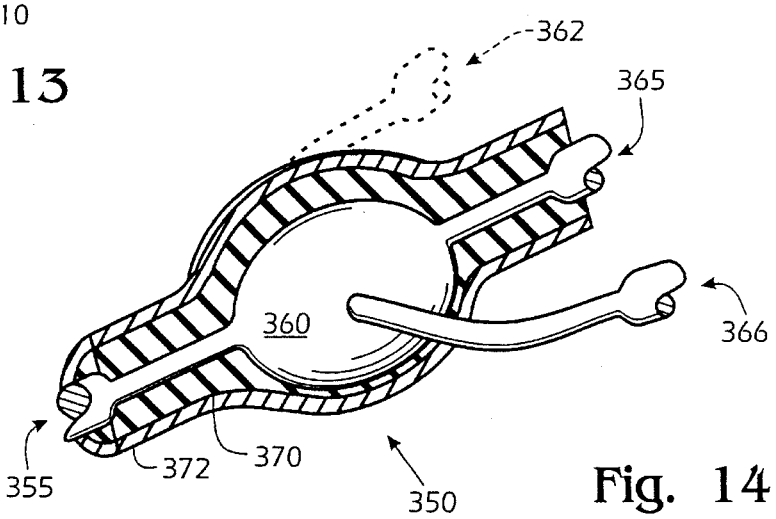
FIG. 14 is a perspective cut away view of a coupler that is larger in a third dimension made according to the invention.

Referring to FIG. 14, a perspective cut away view of an exemplary non-planar coupler 350 according to the invention is shown. This coupler has an input terminal 355 coupled to a bulbous mass 360 from which extends an output terminal 365 and a tap 366. Additional taps may be provided and they are indicated generally by tap 367 which is shown in dashed lines.

The coupler 350 is surrounded by a dielectric material 370 which is in turn surrounded by a ground plane 372. The size of the dielectric layer and ground plane are not drawn to scale and appropriate dimensions and fabrication techniques for forming a coaxial cable about the coupler 350 with appropriate impedance (for example, 50 Ohms) are known in the art. Though not shown from the cut away perspective, dielectric material 370 and ground plane 372 also cover tap 366 and tap 367, if the latter is used.

With non-planar solid couplers, such as coupler 350 of FIG. 14, split ratios much larger than 10 may be achieved.

INDUSTRIAL APPLICABILITY

The reentrant power coupler of the present invention has many embodiments and variations thereof. As such, it has broad industrial applicability.

In a first type of application, the reentrant power coupler may be used where any conventional power coupler is presently used. This includes communication systems, radar, appliances, industrial equipment, and the like.

In addition to conventional applications, the reentrant power coupler also permits new applications such as use in low cost, low power satellite transmission systems, including the low earth orbit (LEO) communications system. The increased split ratios in the above disclosed couplers allow the formation of radio frequency receivers and transmitters that are powerful enough for satellite communication and have a sufficiently broad bandwidth, while maintaining a low cost.

Furthermore, in another application, the reentrant coupler may be used for sensing a signal. Signal sensing entails determining whether a signal is present, relatively uncorrupted, and/or at the right level. The reentrant coupler of the present invention permits the diversion of only a very small portion of an initial input signal for determining the above, and thus is minimally corruptive of that initial input signal. Sensing in this manner is particularly important when signal power loss due to sending is critical.

It should also be recognized that the non-planar couplers can handle much larger power, for example, in the kilowatt range.

While the invention has been described in connection with specific embodiments thereof, it will be understood that it is capable of further modification, and this application is intended to cover any variations, uses, or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

We claim:

1. A power coupler for use with millimeter and microwave signals, comprising:

a signal propagating input terminal having first bifurcation means with at least a first and a second signal propagation section connected thereto;

a first signal propagating output terminal having a recombination means with at least a third and a fourth signal propagation section connected thereto;

a first signal path from said input terminal to said first output terminal that includes said first section coupled to said third section such that at least a portion of a signal input to said first section is propagated to said third section; and a second signal path from said input terminal to said first output terminal that includes said second section coupled to said fourth section such that at least a portion of a signal input to said second section is propagated to said fourth section;

a power dividing tap having a first end coupled to said second signal path between said second and fourth sections and an opposite end coupled to a second signal propagation output terminal; and at least one quarter wavelength section coupled between said second section and said power dividing tap having a cross-sectional area at its input that is less than a cross-sectional area at its output for transforming down in impedance, and at least one quarter wavelength section coupled between said power dividing tap and said fourth section having a cross-sectional area at its input that is greater than a cross-sectional area at its output for transforming up in impedance.

2. The coupler of claim 1, wherein said second path includes at least two downward transforming quarter wavelength sections between said second section and said tap and at least two upward transforming quarter wavelength sections between said tap and said fourth section.

3. The coupler of claim 1, wherein said tap has a transverse cross-sectional area that is substantially less than that of said second signal path where said tap is coupled thereto.

4. The coupler of claim 3, wherein said tap further comprises a quarter wavelength section transforming down in impedance coupled between said first end and said opposite end.

5. The coupler of claim 1, wherein said first signal path is independent of said second signal path and has a number of quarter wavelength sections equivalent to that of said second path.

6. A power coupler for use at millimeter and microwave frequencies, comprising:

a non-bifurcated input signal propagating segment approximately an odd multiple of one quarter of a design wavelength in length and having a predefined characteristic impedance and a cross-sectional area that is greater than that of a transmission line to which it is coupled;

a non-bifurcated output signal propagating segment approximately an odd multiple of one quarter of said design wavelength in length and having approximately the same characteristic impedance and cross-sectional area as said input segment, said output segment also having a common physical boundary along one side with said input segment; and a tap segment having a first end that is formed integrally with said input and output segments at said physical boundary and a second end that is coupled to a tap output, said tap segment having a cross-sectional area perpendicular to the current flow in said tap segment that is substantially less than the cross-sectional area of said input or output segments at said common boundary and an approximate length of an odd multiple of one quarter of said design wavelength;

wherein a minor portion of the current input to said input segment propagates to said tap and a major portion propagates to said output segment, and further wherein said minor portion is determined by a relationship between the cross-sectional area of said tap and the surface area of said input and output segments at their common boundary.

7. The power coupler of claim 6, wherein said input and output segments are made of a solid, singular piece of conducting material.

8. The power coupler of claim 6, wherein said characteristic impedance of said tap segment is at least twice that of said input segment.

9. The power coupler of claim 6, wherein said tap segment has a characteristic impedance that is higher than said predefined characteristic impedance.

10. A power coupler suitable for microwave and millimeter bands, comprising:

an input segment an odd multiple of $\lambda/4$ in length and configured to realize a downward transformation of impedance of an input power signal;

an output segment an odd multiple of $\lambda/4$ in length and configured to realize an upward transformation of impedance of a power signal prior to output, wherein said input and output segments share a common physical boundary, thereby forming an input/output segment pair, and the impedance at said boundary approaches a minimum; and an output tap having a characteristic impedance that is higher than said minimum impedance and which is an odd multiple of $\lambda/4$ in length and formed integrally with said input/output segment pair approximately where said impedance approaches said minimum.

11. The power coupler of claim 1, wherein said coupler has a substantially non-planar geometry and the cross-sectional area at said boundary is at least as great as it is at the ends of the input and output segments opposite therefrom.

12. The power coupler of claim 11, wherein said input/output pair is generally ovoid shaped.

13. The power coupler of claim 10, wherein said input/output segment pair is configured to substantially form a disk.

* * * * *